United States Patent [19]

Schine

[11] Patent Number: 4,914,426

[45] Date of Patent: Apr. 3, 1990

[54] SINUSOIDALLY MODULATED DOT-MATRIX DATA DISPLAY SYSTEM

[75] Inventor: Jonathan M. Schine, Los Angeles, Calif.

[73] Assignee: High Resolution Sciences, Inc., Los Angeles, Calif.

[21] Appl. No.: 81,654

[22] Filed: Aug. 4, 1987

[51] Int. Cl.[4] ..... G09G 1/16

[52] U.S. Cl. ..... 340/736; 340/728; 340/731; 358/13; 358/21 R

[58] Field of Search ..... 340/728, 731, 748, 750, 340/744, 736; 358/11, 13, 21 R, 41, 68, 213.68; 315/365, 399

[56] References Cited

U.S. PATENT DOCUMENTS

| | | | |
|---|---|---|---|
| 4,589,012 | 5/1989 | Songer | 358/12 |
| 4,639,766 | 1/1987 | Schine | 358/21 R |
| 4,684,937 | 8/1987 | Schine | 340/728 |
| 4,697,177 | 9/1987 | Schine | 340/744 |
| 4,710,764 | 12/1987 | Van Cang | 340/728 |
| 4,712,102 | 12/1987 | Troopes et al. | 340/728 |
| 4,719,456 | 1/1988 | Sproch et al. | 340/748 |
| 4,737,693 | 4/1988 | Schine | 315/399 |

*Primary Examiner*—David K. Moore
*Assistant Examiner*—M. Fatahi Yar
*Attorney, Agent, or Firm*—Freilich, Hornbaker, Rosen and Fernandez

[57] ABSTRACT

Display of alphanumeric characters symbols, graphs and other information in a dot-matrix form on a CRT is enhanced by modulating the CRT beam sinusoidally at twice the dot matrix clock rate to produce two full cycles of sinusoidal modulation for each dot space. The amplitude of the modulation is selected to be one-fourth the raster scan spacing of the CRT, whereby two sinusoidal cycles of modulation in each dot space more fully fills the space allocated to a dot display in the vertical direction as the electrons beam scans the dot space in the horizontal direction.

4 Claims, 2 Drawing Sheets

SINUSOIDALLY MODULATED DOT-MATRIX DATA DISPLAY SYSTEM

BACKGROUND OF THE INVENTION

This invention relates to a dot-matrix display terminal, and more particularly to enhancement of data displayed on a cathode ray tube (CRT) operated in a raster scan mode.

In the raster scan mode, the electron beam is swept across the screen in parallel lines until the entire frame of the screen has been scanned. The beam is controlled to brighten dots at selected points that define symbols, graphs, diagrams and other character forms that convey information.

For alphanumeric display, a frame is typically divided into 80 columns and 24 rows. Each column provides a character space, and each row provides a line of characters. The character space defined by a column and row count is further subdivided into a matrix of dot positions, typically $8\times11$, where each of seven horizontal dot positions in each of ten scan lines may be selectively brightened to make up a character. The useful dot matrix within a character space is thus $7\times10$, leaving a clear scan line to separate lines of characters, and a clear column at the beginning of each character space to separate characters in a line. Consequently, the entire frame displayed is divided into an array of $560\times264$ adjacent dot spaces, although some spaces are used to provide spaces between characters and between lines of characters, and within a matrix, only those actually needed to form a character are used while displaying data.

For graphs diagrams and other forms that convey information, the entire frame constitutes one matrix of $560\times264$ dot spaced. The difference between alphanumeric display and display of such other forms is simply that a character generator is not used, and instead a computer composes the display by sequentially generating data display bits (binary digits) that are combined in a mixer to produce a composite video signal for control of a cathode ray tube (CRT).

An enhanced data display system for alphanumeric characters and other symbols is disclosed in U.S. Pat. No. 4,697,177. The technique applied there consisted of synchronously modulating the horizontal scan of the CRT to produce one sinusoidal oscillation of the electron beam in each dot space of a matrix. The effect produced was to slant each dot inherently elongated into an ellipse because of the finite time required to turn the beam on and then off in producing a dot for display. Otherwise the dots along a vertical character line have visible spaces between them; only horizontal character lines are display as solid lines. That slanting dot technique worked well for filling in space between dots in character lines 90° from the horizontal, and for lines between 90° and the horizontal, but for lines at an angle below the horizontal, the space between dots appears again as the major axis of the ellipse produced for each dot approaches a position normal to the character line, with a maximum space when the character line is at an angle 45° below the horizontal, i.e., below the "horizontal" scan line of the electron beam. An object of this invention is to improve upon that technique to minimize the space between adjacent dots in a dot matrix display, both vertically and horizontally.

For data display purpose, a clock generator operating in the megahertz range is divided down to obtain a 60 Hz vertical (V) sync rate, and down further to get horizontal (H) sync rates, thereby producing a frame display at the rate of 60 per second. This chain of dividers will not only synchronize the data display with the horizontal and vertical scan of frames (noninterlaced fields), but provide the addressing information necessary to read out into a shift register trains of binary digits, where each bit 1 will cause the beam to brighten a dot as a line is scanned. When the entire raster of lines for a frame have been scanned, and all data has been displayed, the data will have been displayed in $560\times264$ dot spaced. A computer which generates or controls the train of $560\times264$ bits will update the information to be displayed in each frame, either directly or through a controller having a random access memory which then provides the data bits in sequence. This generation or control may be for alphanumeric display of data in a space divided into 80 columns and 24 rows of characters in spaced of $8\times11$ dot positions, or for any information that may be composed of a total frame space of $560\times264$ dots. While the number of dots for character space, or a total frame space, may differ in some systems, it should be noted that the technique for enhancing the dot matrix data display to be described is not dependent on the number of dots. However, to illustrate the invention in one specific embodiment a character space of $8\times11$ dot spaces, and a frame of alphanumeric data divided into 80 columns and 24 rows.

For each character space, a shaft register is loaded with a new train of binary digits a a line of data is displayed. These binary digits define the dots to be displayed and, as the last of the previous train is shifted out into a video mixer that combines sync and blanking with the binary digits into a composite signal for display, the next set of binary digits is loaded into the shaft register. In the CRT display unit, a horizontal (H) and vertical (V) drive generator responds to the horizontal and vertical sync pulses to produce the horizontal and vertical drive signals applied to deflection coils, while the binary digits from the shift register, and the blanking signals, are applied to the cathode of the CRT. In that way, the beam is brightened for dots defined by 1 bits out of the shaft register, and blanked at all other times while 0 bits are shifted out and while the blanking signals for line and field retrace are present.

To form a line of characters the clock frequency divider is used to address a random access memory (RAM) for each line of 80 characters, one character at a time in sequence. Each output character code, together with the output of a counter that counts the lines of characters, addresses a character generator implemented with a read only memory (ROM) to produce in sequence the corresponding lines of binary digits that define the characters in the row addressed. A shift register receives the binary digits in parallel for one character at a time in sequence, and converts them into a continuous serial train. After the procedure has been repeated ten times for one line of 80 characters, the address to the RAM is advanced to the next line of 80 characters. In that manner the output of the RAM addresses the character generator to convert the character code out of the ROM into the binary digits that define the positions of dots for the characters.

The number of raster scans per frame is limited, typically to 280. For a block of $80\times24$ characters, with an $8\times11$ dot matrix for each character, for example, there must be $11\times24=264$ raster scans used. The rest of the time (26 raster scans) is not available for data display, and is instead partly used for field retrace, although sometimes 11 raster scans are used for display of operation information, such as terminal status, host messages, set-up mode or function key legends.

As noted hereinbefore, each dot is in actuality displayed as an ellipse with its major axis horizontal due to the velocity of the beam across the CRT screen. Consequently, adjacent horizontally spaced dots run together, while adjacent vertically spaced dots do not, particularly when the width of the dot spaced is reduced in order to display 80 characters in a line. The result is that the characters appear to be made up of discrete dots in vertical and diagonal portions of a characters, and solid bars in horizontal portions. This deficiency in the vertical and diagonal directions provides rather low definition of characters displayed.

A simple way to increase vertical resolution would be to use interlaced fields so that the odd field is displaced a half raster scan spaced, but since the data being displayed is constant until changed, the characters will appear to flicker up and down a half line space. That is quite disturbing to the viewer. It is therefore preferable to use noninterlaced fields (referred to herein for this invention as frames) to display data refreshed 60 times per second. The problem is to enhance the data display within those constraints in a manner that does not have the deficiency of the technique disclosed in the aforesaid patent application.

SUMMARY OF THE INVENTION

In accordance with the present invention, data display is enhanced by vertical modulation of the horizontal raster scans at a frequency that will produce two complete cycles per dot space. For optimum results, the depth of modulation should be at least $\pm\frac{1}{4}$ the spacing of the raster scans, depending on beam width, dot duration, and line spacing. Then, as binary digits that define data to be displayed is presented, clocked at the frequency required for a line of dots to be displayed in a raster scan, each dot is displayed during a portion of two cycles of modulation in the dot space. The phase of the modulation is adjusted relative to the clock so that a dot display is centered on the two cycles of modulation. In that manner, the elliptical dots which would otherwise be displayed are modulated along their horizontal major axis. The space between dots in every direction is thus reduced. This improvement is achieved without degrading the horizontal resolution.

The novel features of the invention are set forth with particularity in the appended claims. The invention will best be understood from the following description when read in conjunction with the drawings.

DESCRIPTION OF PREFERRED EMBODIMENTS

Figure 1:
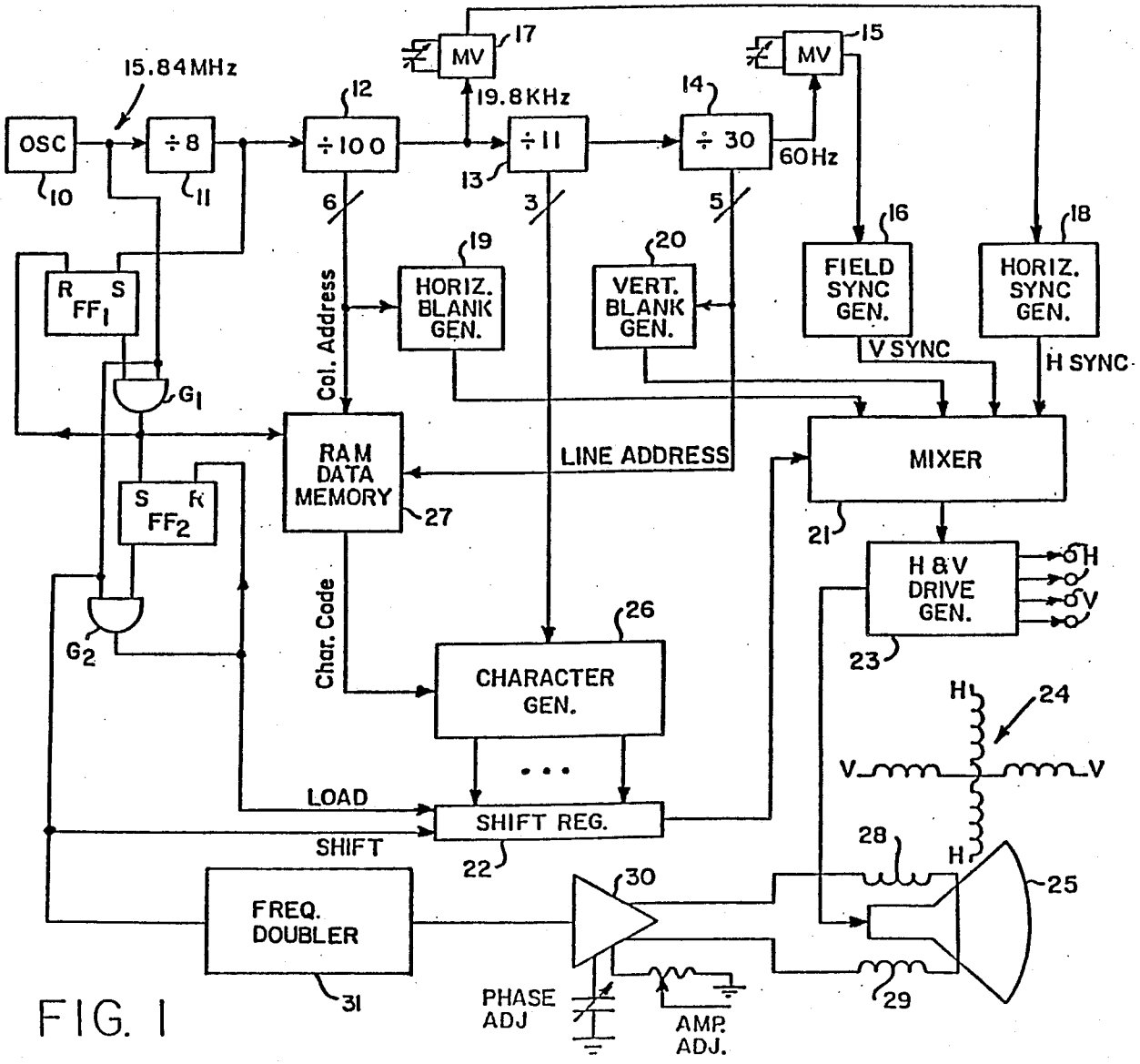
FIG. 1 is a block diagram of one embodiment of the present invention.

Referring now to FIG. 1, the portion of a data display system into which the present invention is incorporation will first be described. Then the present invention incorporation therein will be described in detail. For simplicity, a conventional display of 80 columns and 24 rows of data is used in the example of a preferred embodiment.

A clock generator 10 operating at 15.84 MHz is connected to a frequency dividing chain comprised of binary counters 11 through 14. The output of the last counter 14 at 60 Hz is connected by a delay multivibrator 15 to a vertical (V) sync generator 16 for field synchronization. The output of the counter 12 at 19.8 KHz is connected by a delay multivibrator 17 to a horizontal (H) sync generator 18 for synchronizing the display of 330 rasters at the rate of 60 fields per second. The multivibrators are included to provide variable delay that can be used to adjust the timing of the H and V sync pulses.

The H and V sync pulses are combined with raster and field blanking signals derived from blanking generators 19 and 20 which decode the outputs of counters 12 and 14 to produce horizontal and vertical blanking signals at all points outside the $80\times24$ character display, as determined by the column address from the counter and the line address from the counter 14. The H and V pulses are combined in a mixer 21 which adds dot display signals from a shift register 22 to produce a composite character display signal. This composite signal is applied to a conventional horizontal and vertical (H and V) drive generator 23 which drives the H and V deflection coils in a yoke 24 of a cathode ray tube 25, and passes on the dot display signals to the cathode of the cathode ray tube.

The dot display signals from the shift register represent a continuous train of dot-matrix coded binary digits in groups of 8, one group for each of 40 characters of a line of data. To produce the entire line of characters, each in an $8\times11$ dot matrix, a set of 11 trains, each of 640 bits, are read into the shaft register 22 from a character generator 26 in groups of 8 bits, one 8-bit character code for each of 80 characters repeated eleven times for each of the eleven rows of the 80 characters. In actual practice, the ROM stores only the bits of the $7\times10$ part of the dot matrix space. The eighth bit not read from the ROM is effectively inserted into the train at the output of the shift register 22, and the eleventh 8-bit code for each character may be effectively implemented at the line address input of the character generator which decodes the eleventh line address, and in response to that, force the output of the ROM to be zero regardless of the character code being received.

The divider 12 is used to address a RAM data memory 27 for the 80 characters in a line. Note that there are 100 possible character addresses generated by the divider 12, but only character addresses 10 through 90 are decoded, thereby effectively providing a blank space of 10 characters on each side of the data display block which is forced to be blank by the horizontal blanking generator 19.

The RAM data memory is advanced from line to line by a line address form the divider 14. Here again there are 30 line addresses possible, but the RAM memory only accepts addresses for lines 2 through 25 thereby effectively leaving one blank line above and five blank lines below the $80\times24$ block of data which is forced to be blank by the vertical blanking generator 20. A 25th line of operating information may be displayed in one of the remaining five, such as the second line, leaving the remaining three lines for field retrace.

The output of the divider 11 sets a flip-flop $FF_1$ which enables an AND gate $G_1$ to transmit the next clock pulse from the clock generator 10. That transmitted pulse not only synchronizes the operation of the RAM data memory in reading out a character code as an address for the character generator, but also resets the flip-flop $FF_1$. The output of the AND gate $G_1$ sets a flip-flop $FF_2$ to enable an AND gate $G_2$. The next clock pulse from the clock generator 10 is then passed so as to not only load the shift register 22 from the character generator output but also reset the flip-flop $FF_2$.

Each character code read out of the RAM data memory may be according to any code for which the character generator is designed, such as ASCII. That code is used to address the character generator 26 which has stored the dot code matrix for each character. Assuming an $8\times10$ matrix, the character generator 26 addresses each of the ten consecutive rows of the 80 matrices specified in sequence by the character code from the RAM data memory 27. As the RAM data memory is advanced across forty characters for ten consecutive times, the divider 14 holds the same line address, but each time the output of the divider 12 increments the divider 13, the output of the divider 13 is advanced by one to advance the character generator 26 to the next row of bits that define all Mxn matrices of the 80 characters in the line of data displayed.

The synchronized load of a 7-bit code may take place during the time the nonexistant eighth bit is read out of the shift register 22. If this is the last bit of the character generator code, left blank for spacing from the next character generator code, the shift pulse is effectively shifting out a bit 0 at the time the next 7-bit code is loaded into the shift register. This is accomplished in the shift register which has 7 stages to store a 7-bit code, and, after shifting out 7 bits, the load signal occurs overriding the shift control and forcing the output of the shift register to zero. That is done by an inhibit gate on the shift input that receives the load signal at its inhibit input, and an output gate normally enabled to pass the bits shifted out except during the presence of a load signal. In that manner, the eighth bit not read from the ROM is effectively inserted as a bit 0 in the 8-bit train at the output of the shift register 22.

Figure 2A:
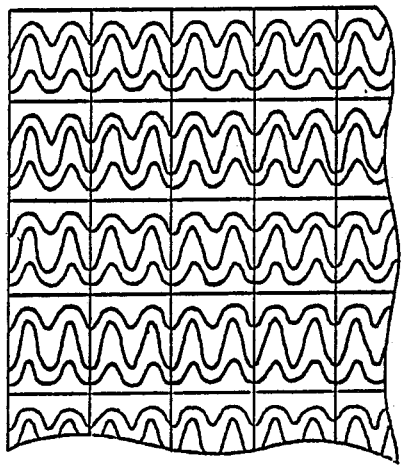
FIG. 2*a* illustrates the modulated raster scan of one $8\times10$ character space and FIG. 2*b* illustrates one dot space with a dot display superimposed on the two cycles of sinusoidal modulation in the scan of the dot space.
Figure 2B:
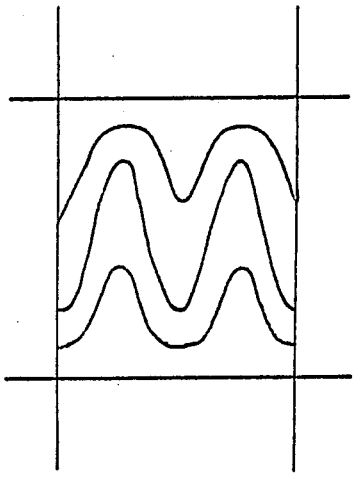

The foregoing arrangement is common to virtually all data display terminals that have been devised in accordance with the teachings of U.S. Pat. No. 3,345,458, with only minor variations in implementation. The present invention departs from the foregoing by using the output of the frequency divider 11 (the shift pulse train) to drive auxiliary vertical deflection coils 28 and 29 via an amplifier 30 having phase and amplitude control so that for each dot space of eery $8\times11$ matrix, i.e., for each dot space of a frame, the CRT electron beam is modulated through two cycles, as shown in FIG. 2*a*. The phase of modulation is preferably adjusted relative to the dot spaces to place two complete cycles within each dot space, as shown in FIG. 2*b*, but that is not a critical necessity; it is sufficient for the modulation frequency to be double the dot rate, i.e., double the frequency of shift pulses applied to the shift register 22. That is accomplished by a frequency doubler 31 at the input of the modulation drive amplifier. A suitable circuit for the frequency doubler and drive amplifier is disclosed in U.S. Pat. No. 4,737,693. The amplitude of modulation is adjusted for the desired slope with respect to the horizontal, such as one fourth of the raster scan spacing. In practice the dots are displayed with a diameter at least a quarter of a row spacing, and preferably between a half and a full row spacing. With a dot diameter of $\frac{1}{2}$ a line space and an amplitude of modulation of one fourth a raster can spacing, virtually all the space between dots on successive rows will be filled with the electron beam spot, thereby enhancing the dot matrix display in the vertical dimension without degrading it in the horizontal dimension.

By displaying the dots with a double frequency sinusoidally modulated of the raster scan, the tendency for the dots to be drawn out in a horizontal direction due to bandwidth limitation of the cathode ray tube is not disturbed, but is stretched out to cover space above and below the raster center line. This stretching out is more pronounced because the electron beam is moving at a faster speed than if the scan were in a straight horizontal line. So instead of the dots being elongated horizontally, the dots are stretched out in the vertical direction to present a more nearly square dot that fills in space between adjacent dots in a vertical direction. This does not affect the tendency of horizontally adjacent dots to run together, and significantly increases the running together of vertically adjacent dots, for enhanced vertical and diagonal continuity of the data displayed.

Although particular embodiments of the invention have been described and illustrated herein, it is recognized that modifications and variations, such as modulating the beam at frequencies greater than or less than 2 cycles per dot space, or having a noninteger number of cycles per dot space, may readily occur to those skilled in the art. Consequently, it is intended that the claims be interpreted to cover such modifications and variations.

What is claimed is:

1. A method of enhancing the dot matrix display of data on a system using a cathode ray tube for display, wherein the data display is formed by dots in a dot matrix, comprising the steps of producing a train of binary digits defining the data to be displayed as a matrix of dots with a maximum of one dot display in each dot space of the matrix consisting or horizontal rows and vertical columns of dot space positions, and sinusoidally modulating the cathode ray tube beam in a vertical direction as it scans horizontally for display of rows of dots in a raster with a frequency of sinusoidal modulation that provides two cycles of sinusoidal modulation per dot space, wherein only one dot is to be displayed, thereby to more fully fill the dot space of each dot displayed in a vertical dimension relative to the center line of the raster scan without affecting the horizontal dimension of a dot displayed.

2. A method as defined in claim 1 wherein the amplitude of said modulation is selected to be at least $\pm\frac{1}{4}$ the raster scan spacing of said cathode ray tube display system.

3. In a cathode ray tube display system for generating dot-matrix patterns for display of information with a beam of electrons, each pattern being displayed in a matrix of rows and columns of dot spaces, said system having a means for producing a train of binary digits defining dots in said matrix for information to be displayed with a maximum of one dot per dot space, an improvement comprising means for modulating the vertical deflection of said beam as it raster scans horizontally with a frequency of modulation selected to produce two cycles of modulation in each dot space, wherein only one dot is to be displayed, thereby to more fully fill the dot space of each dot displayed in a vertical dimension relative to the center line of the raster scan without affecting the horizontal dimension of a dot displayed.

4. The improvement of a data display system as defined in claim 3 wherein the amplitude of said modulation is selected to be at least about $\pm\frac{1}{4}$ the raster scan spacing of said cathode ray tube.

* * * * *